US010950082B2

(12) United States Patent
Keilwert et al.

(10) Patent No.: US 10,950,082 B2
(45) Date of Patent: Mar. 16, 2021

(54) PROVIDING WAGERING GAMES WITH MULTIPLE RESOLUTION OPTIONS AT GAMING DEVICES, AND RELATED SYSTEMS AND METHODS

(71) Applicant: IGT, Las Vegas, NV (US)

(72) Inventors: Stefan Keilwert, St. Josef (AT); Klaus Achmuller, Kaisdorf bei Graz (AT)

(73) Assignee: IGT, Las Vegas, NV (US)

( * ) Notice: Subject to any disclaimer, the term of this patent is extended or adjusted under 35 U.S.C. 154(b) by 23 days.

(21) Appl. No.: 16/356,718

(22) Filed: Mar. 18, 2019

(65) Prior Publication Data

US 2020/0302735 A1 Sep. 24, 2020

(51) Int. Cl.
*G07F 17/34* (2006.01)
*G07F 17/32* (2006.01)

(52) U.S. Cl.
CPC ..... *G07F 17/3211* (2013.01); *G07F 17/3227* (2013.01); *G07F 17/3232* (2013.01); *G07F 17/3262* (2013.01); *G07F 17/34* (2013.01)

(58) Field of Classification Search
CPC .. G07F 17/3258; G07F 17/3262; G07F 17/34; G07F 17/3267; G07F 17/3211; G07F 17/3237; G07F 17/3255; G07F 17/3286; G07F 17/3232; G07F 17/326; G07F 17/3269; G07F 17/3293
See application file for complete search history.

(56) References Cited

U.S. PATENT DOCUMENTS 7,758,416 B2 * 7/2010 Randall ..... G07F 17/32 463/20
8,974,281 B2 * 3/2015 Beaulieu ..... A63F 13/12 463/16
9,082,261 B2 * 7/2015 Caputo ..... G07F 17/3267
2002/0183105 A1 * 12/2002 Cannon ..... G07F 17/3267 463/16
2003/0060255 A1 * 3/2003 Baerlocher ..... G07F 17/32 463/16
2003/0100361 A1 * 5/2003 Sharpless ..... G07F 17/3267 463/25
2006/0142077 A1 * 6/2006 Miles ..... G07F 17/34 463/20
2011/0263312 A1 * 10/2011 De Waal ..... G07F 17/34 463/20
2015/0072766 A1 * 3/2015 Hughes ..... G07F 17/326 463/25
2015/0287267 A1 10/2015 Keilwert
(Continued)

*Primary Examiner* — Justin L Myhr
(74) *Attorney, Agent, or Firm* — Sage Patent Group

(57) ABSTRACT

In response to determining that a triggering condition has been satisfied, a plurality of resolution options for a plurality of wagering games may be provided to a gaming device for display. The plurality of resolution options includes a first resolution option that includes resolving a first number of instances of a first subset of the plurality of wagering games, and a second resolution option that includes resolving a second number of instances of a second subset of the plurality of wagering games. The first number of instances is different from the second number of instances, and the first subset is different from the second subset. The plurality of wagering games is then resolved according to one of the plurality of resolution options.

20 Claims, 8 Drawing Sheets

(56) References Cited

U.S. PATENT DOCUMENTS

| | | | | |
|---|---|---|---|---|
| 2015/0348355 | A1* | 12/2015 | Caputo | G07F 17/3267 463/31 |
| 2017/0103613 | A1* | 4/2017 | Berman | G07F 17/3244 |
| 2019/0073878 | A1* | 3/2019 | Kendall | G07F 17/34 |

* cited by examiner

PROVIDING WAGERING GAMES WITH MULTIPLE RESOLUTION OPTIONS AT GAMING DEVICES, AND RELATED SYSTEMS AND METHODS

BACKGROUND

Embodiments relate to providing wagering games, and in particular to providing wagering games with multiple resolution options at gaming devices, and related systems and methods. Gaming devices, such as electronic gaming machines (EGMs), are systems that allow users to place a wager on the outcome of a random event, such as the spinning of mechanical or virtual reels or wheels, the playing of virtual cards, the rolling of mechanical or virtual dice, the random placement of tiles on a screen, etc. Manufacturers of gaming devices have incorporated a number of enhancements to the gaming devices to allow players to interact with the gaming devices in new and more engaging ways. For example, early slot machines allowed player interaction by pulling a lever or arm on the machine. As mechanical slot machines were replaced by electronic slot machines, a range of new player interface devices became available to gaming devices designers and were subsequently incorporated into gaming devices. Examples of such interface devices include electronic buttons, wheels, and, more recently, touchscreens and three-dimensional display screens.

SUMMARY

According to an embodiment, a gaming system is disclosed. The gaming system includes a processor circuit and a memory coupled to the processor circuit. The memory includes machine-readable instructions that, when executed by the processor circuit, cause the processor circuit to determine whether a triggering condition has been satisfied for a gaming device. The machine-readable instructions further cause the processor circuit to, in response to determining that the triggering condition has been satisfied, provide a plurality of resolution options for a plurality of wagering games to the gaming device for display. The plurality of resolution options for resolving the plurality of wagering games includes a first resolution option including resolving a first number of instances of a first subset of the plurality of wagering games, and a second resolution option including resolving a second number of instances of a second subset of the plurality of wagering games. The first number of instances is different from the second number of instances, and the first subset of the plurality of wagering games is different from the second subset of the plurality of wagering games. The machine-readable instructions further cause the processor circuit to resolve the plurality of wagering games according to one of the plurality of resolution options.

According to another embodiment, a computer-implemented method of operating a gaming system is disclosed. The method includes determining, by a processor circuit of the gaming system, whether a triggering condition has been satisfied for a gaming device. The method further includes, in response to determining that the triggering condition has been satisfied, providing a plurality of resolution options for a plurality of wagering games to the gaming device for display. The plurality of resolution options for resolving the plurality of wagering games includes a first resolution option including resolving a first number of instances of a first subset of the plurality of wagering games, and a second resolution option including resolving a second number of instances of a second subset of the plurality of wagering games. The first number of instances is different from the second number of instances, and the first subset of the plurality of wagering games is different from the second subset of the plurality of wagering games. The method further includes resolving the plurality of wagering games according to one of the plurality of resolution options.

According to another embodiment, a gaming device is disclosed. The gaming device includes a display device, an input device, a processor circuit, and a memory coupled to the processor circuit. The memory includes machine-readable instructions that, when executed by the processor circuit, cause the processor circuit to determine whether a triggering condition has been satisfied. The machine-readable instructions further cause the processor circuit to, in response to determining that the triggering condition has been satisfied, provide a plurality of resolution options for a plurality of wagering games to the display device for display. The plurality of resolution options for resolving the plurality of wagering games include a first resolution option including resolving a first number of instances of a first subset of the plurality of wagering games, and a second resolution option including resolving a second number of instances of a second subset of the plurality of wagering games. The first number of instances is different from the second number of instances, and the first subset of the plurality of wagering games is different from the second subset of the plurality of wagering games. The machine-readable instructions further cause the processor circuit to resolve the plurality of wagering games according to one of the plurality of resolution options.

DETAILED DESCRIPTION

Figure 1:
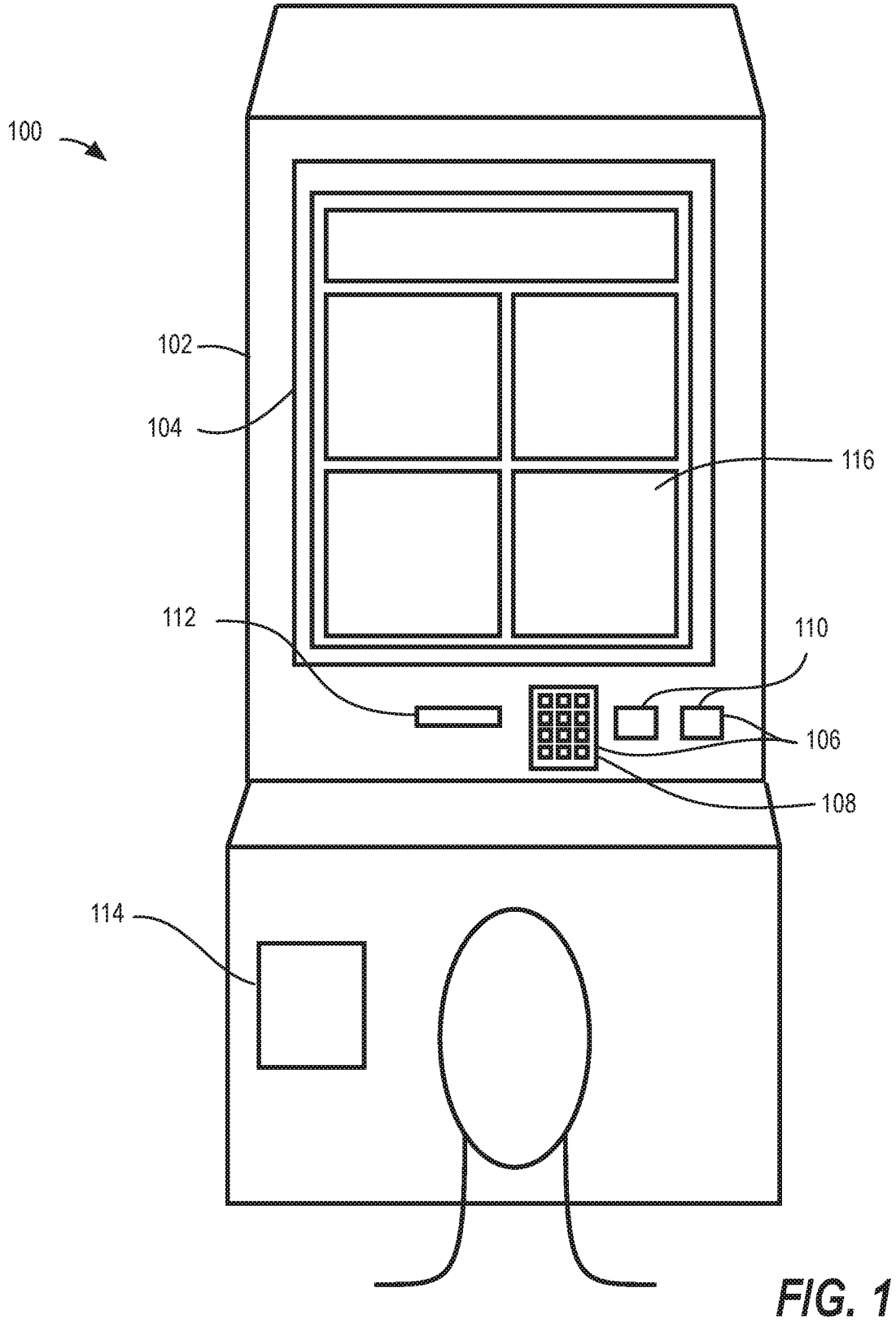
FIG. 1 illustrates a gaming device having a wagering game with multiple resolution options, according to some embodiments.

Embodiments relate to providing wagering games, and in particular to providing wagering games with multiple resolution options at gaming devices, and related systems and methods. In some embodiments, in response to determining that a triggering condition has been satisfied, a plurality of resolution options for a plurality of wagering games may be provided to a gaming device for display. The plurality of resolution options for resolving the plurality of wagering games include a first resolution option that includes resolving a first number of instances of a first subset of the plurality of wagering games, and a second resolution option that includes resolving a second number of instances of a second subset of the plurality of wagering games. The first number of instances is different from the second number of instances, and the first subset of the plurality of wagering games is different from the second subset of the plurality of wagering games. The plurality of wagering games is resolved according to one of the plurality of resolution options, which may be selected by the player prior to resolving the particular resolution option or after resolving the particular resolution option. For example, in some embodiments, the player may select the first or the second resolution option before knowing the result. In other embodiments, all of the resolution options may be resolved and the results of the different resolution options, which may involve different types and/or combinations of awards, may be provided to the player for selection.

One advantage of these and other embodiments is that a player can select between different types of game play, which may have different payouts, award types, volatilities, play styles, or other aspects. For example, a triggering condition may include a condition for initiating a primary wagering game, e.g., receiving a wager, or a condition for initiating a secondary wagering game, e.g., a bonus or free-play game. In one embodiment, the first option may include five spins of four reel-based slot games and the second option may include ten spins of only one of the four slot games. In addition, if the second option is selected, the three non-selected slot games may be simulated simultaneously with resolving the selected slot game, to show the player how resolution of the first option may have proceeded, as a way of enticing the player to select the first option at a future time. Each option may have a predetermined average payout value, which may be equal to each other or different from each other, and may also have a predetermined volatility value, which may also be equal to each other or different from each other, as desired. For example, a player may be enticed into selecting an option that has a lower average payout but that also has a higher volatility, which results in a lower number of larger wins, as opposed to a higher number of comparatively smaller wins. These and other embodiments provide a unique technical solution to the technical problem of providing a variety of gaming and wagering options to players while maintaining an acceptable and predictable revenue stream for operators of gaming devices.

In this regard, FIG. 1 illustrates a gaming device 100 for providing a wagering game with multiple resolution options, according to some embodiments. The gaming device 100 includes a housing 102 having a display device 104, and a plurality of input devices 106, such as a keypad 108, buttons 110, etc., for receiving user input for playing the wagering game and otherwise interacting with the gaming device 100. In some embodiments, the display device 104 may include a touchscreen interface for receiving user input as well. The gaming device 100 may include additional specialized hardware as well, such as an acceptor 112, for receiving currency (i.e., bills and/or coins), tokens, credit or debit cards, or other physical items associated with monetary or other value. The gaming device 100 may also include a dispenser 114, for dispensing items, such as physical items having monetary or other value (e.g., awards or prizes) or other items.

As will be discussed in detail below, the gaming device 100 may include a processor circuit and a memory coupled to the processor circuit. The memory includes machine-readable instructions that, when executed by the processor circuit, cause the processor circuit to perform operations for conducting the wagering games disclosed herein. In this example, the wagering games are conducted using a graphical user interface (GUI) 116 displayed by the display device 104.

Figure 2A:
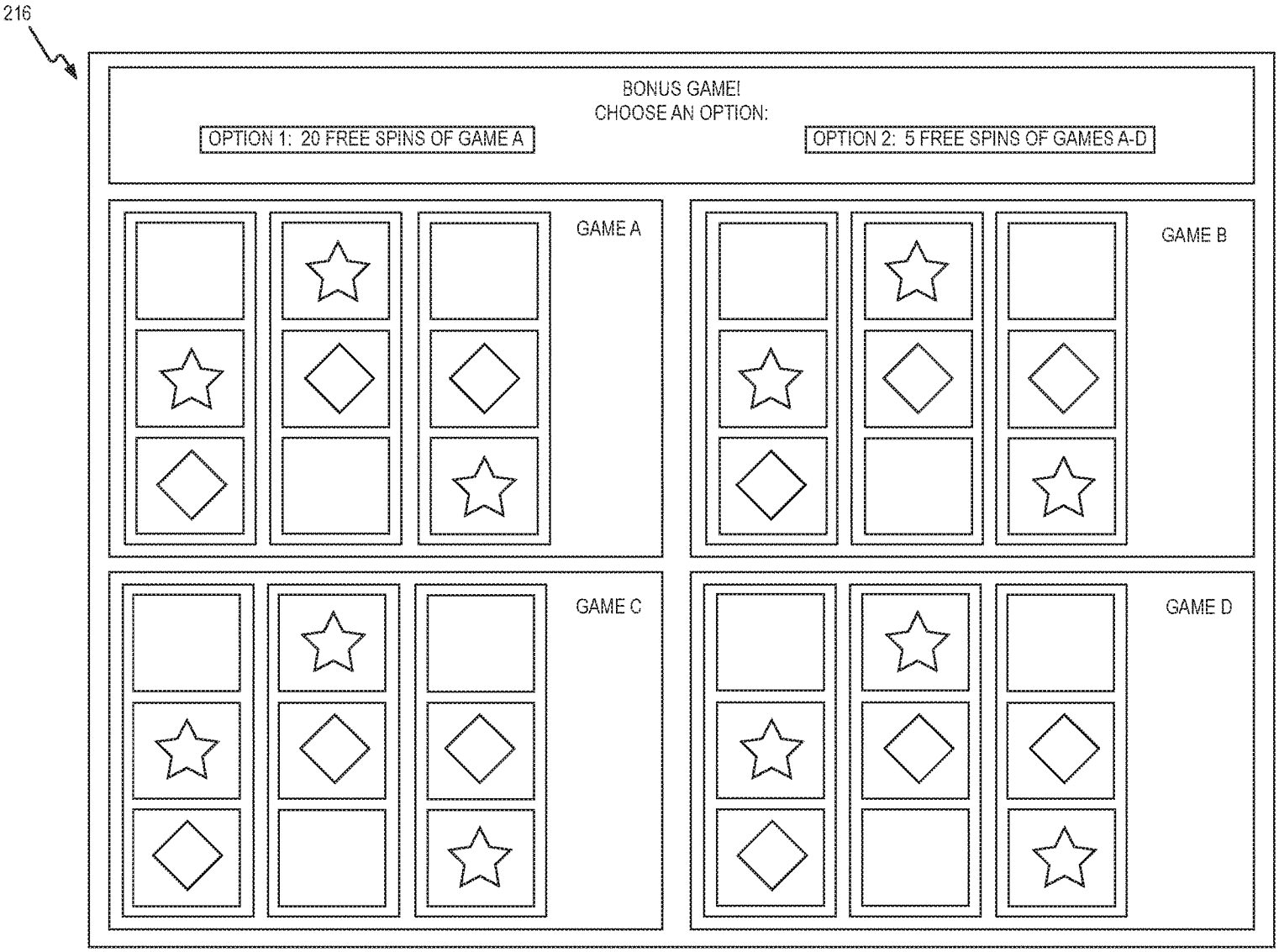
FIGS. 2A-2C illustrate elements a graphical user interface (GUI) for playing a wagering game similar to the wagering game of FIG. 1, according to some embodiments.
Figure 2B:
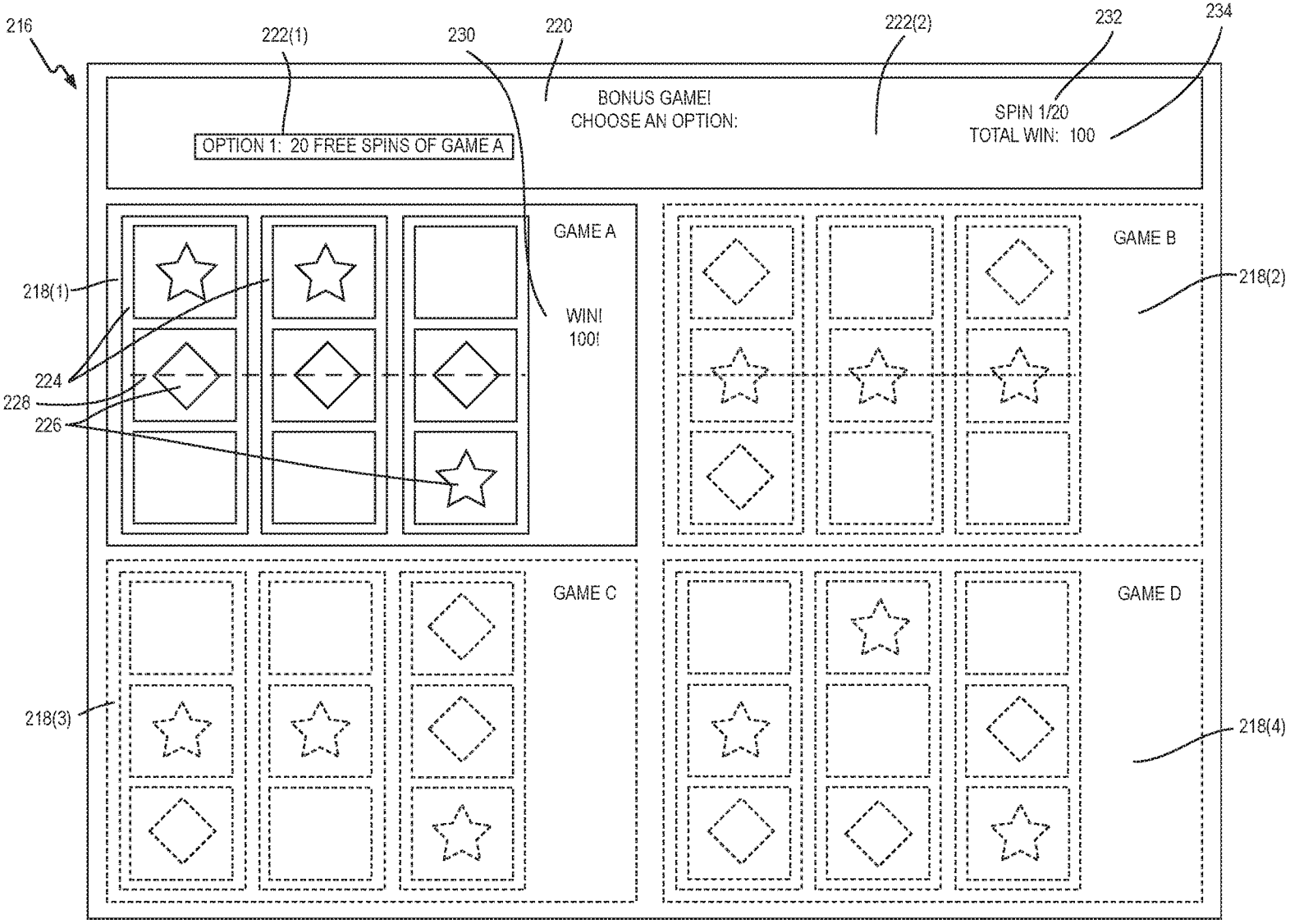
Figure 2C:
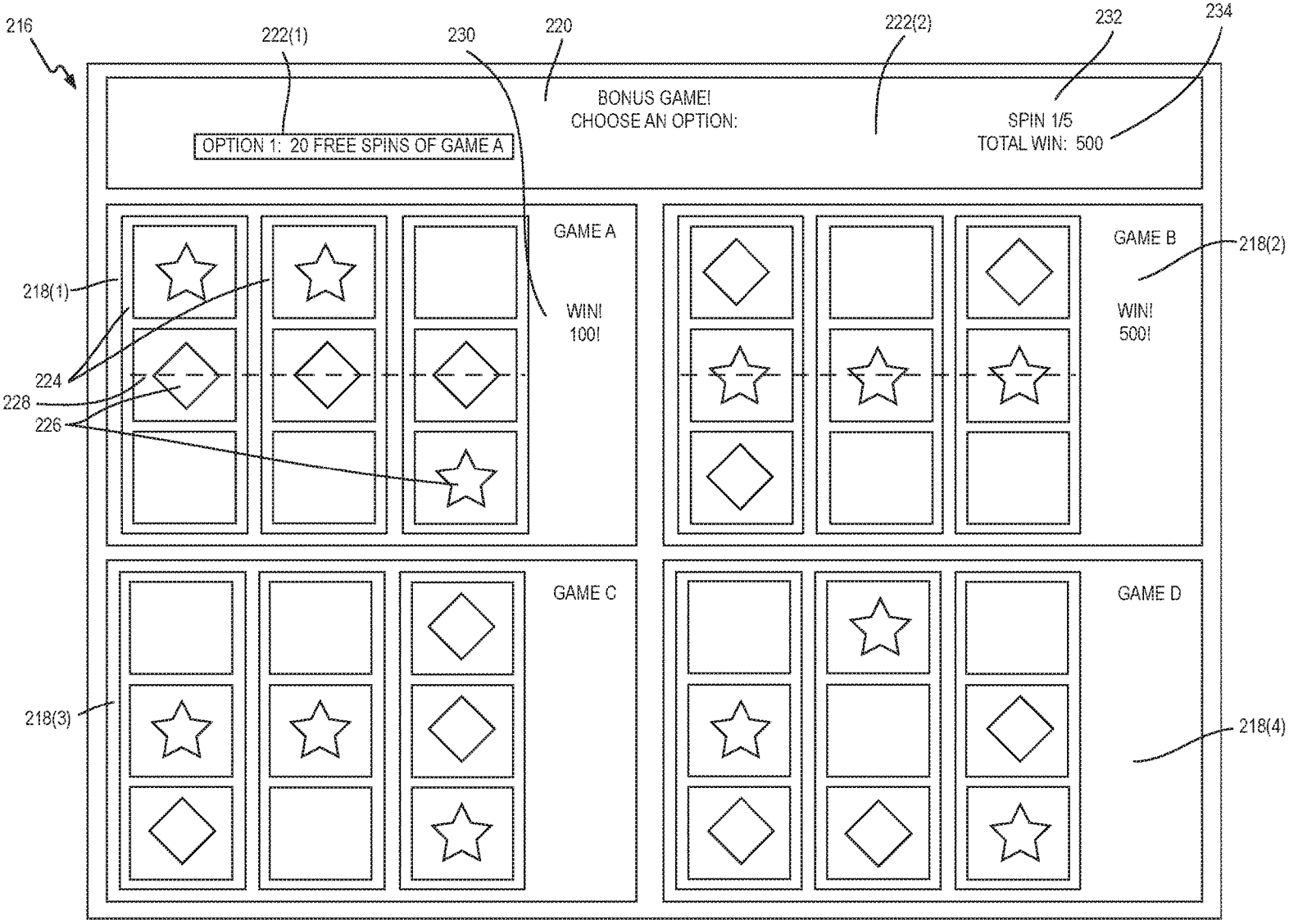

Referring now to FIGS. 2A-2C, elements of a GUI 216 for playing a wagering game having multiple resolution options similar to the GUI 116 of FIG. 1 are illustrated, according to some embodiments. The GUI 216 is controlled in response to machine-readable instructions being executed by the processor circuit. The GUI 216 displays a plurality of four wagering games 218 in a 2×2 tiled arrangement. An information display 220 provides wagering and other information for playing the wagering game(s) 218. In response to a triggering condition being satisfied, which is a bonus game triggering condition based on a resolution of a primary wagering game in this embodiment, the information display 220 displays different resolution options 222 for the plurality of wagering games 218 (i.e. bonus games in this embodiment). It should be understood, however, that other types of triggering conditions may be used, such as determining that a player has placed a wager that satisfies a predetermined wager amount, for example. In this embodiment, the player may select one of the resolution options 222 for resolution, but it should be understood that, in other embodiments, the player may select more than one resolution option 222, and may receive an award for one or more of the selected resolution options 222, as desired. In some embodiments, the number of resolution options that may be selected may be based on a size of the player's initial bet. For example, a minimum (e.g., 1×) bet may qualify the player to select one of the resolution options 222, a 2× bet may qualify the player to select one of the resolution options 222, etc., up to a maximum (e.g., 4×) bet that may qualify the player to select all four of the resolution options 222, with the player selecting or automatically being awarded the best outcome of the multiple resolution options.

A first resolution option 222(1), illustrated in FIG. 2B, includes resolving a first number of instances (e.g., twenty spins) of a first subset of the plurality of wagering games 218 (e.g., the first wagering game 218(1) only). Selecting the first option causes twenty instances of the first wagering game 218(1) to be resolved, with an award based on the resolution of the twenty spins of the first wagering game 218(1) being provided to the player in the event of one or more wins. For example, the wagering games 218 of FIGS. 2A-2D are slot games in which a win is determined by lines and patterns of randomly determined spinning reels 224 each having a plurality of game symbols 226. It should be understood, however, that the wagering games 218 may be any number games or types of games, as desired. In this example, for each instance of the first wagering game 218(1), a win is indicated by particular game symbols 226 of the reels 224 lining up along one or more paylines 228, with each payline 228 and combination of particular game symbols 226 being associated with a particular award 230. The information display 220 may track the progress of the wagering game, such as by displaying the number of instances 232 that have been resolved and that are remaining, and by displaying the total cumulative award 234 as the instances 232 are resolved.

A second resolution option 222(2), illustrated in FIG. 2C, includes resolving a second number of instances (e.g., five spins) of a second subset of the plurality of wagering games 218 (e.g., all four wagering games 218(1)-(4)). Selecting the second option causes five spins of each of the four wagering games 218(1)-(4) to be resolved, with an award based on the resolution of the five spins of the four wagering games 218(1)-(4) being provided to the player in the event of one or more wins. In this example, the first number of instances is larger than the second number of instances, but it should be understood that the first number of instances may be equal to, or smaller than, the second number of instances in other examples. Likewise, in this example, the first subset of wagering games 218 is smaller than the second subset of wagering games 218, but it should be understood that the first subset of wagering games 218 may be equal to, or greater than, the first subset of wagering games 218 in other examples. Resolving an instance of a wagering game may include determining whether game elements of the wagering game indicate a winning condition, and may also include providing an award in response to a winning condition, for example.

In this example, the first number of instances times the number of games in the first subset of the plurality of wagering games 218 is equal to the second number of instances times the number of games in the second subset of the plurality of wagering games 218. This results in the total number of instances of wagering game 218 being resolved in both resolution options 222 to be equal to each other. Each instance of a wagering game 218 may have an average payout value that is consistent across wagering games 218, which would result in both resolution options 222 in this example having the same total average payout value. This has the advantage of preventing player skill from playing a role in selecting between the resolution options 222, while still offering the player an opportunity to choose between different types of game experiences. In other examples, the total number of instances and/or the total average payout for each resolution option may be different from each other. These differences may be apparent to a player, or may be hidden from the player, or a combination thereof, as desired, to increase the effect (or perceived effect) of player skill in choosing between the resolution options 222. For example, in some embodiments, a resolution option that includes multiple wagering games 218 being resolved simultaneously, only the best result of the four wagering games 218 for each instance will count toward the player's award. This allows the operator to offer an option 222 that may have a larger total number of instances of wagering games 218, but that nevertheless has a similar or equal average payout value, because many of the wins for the wagering games 218 will be cancelled out by another win in for another wagering game 218 being resolved as part of the same instance.

In this embodiment, as shown by FIG. 2B, selecting one of the resolution options 222(1) also includes providing a graphical representation of a simulated resolution of instances of the other wagering games 218(2)-(4) that are not part of the resolution option 222(1). In this example, the other wagering games 218(2)-(4) that are simulated as part of the first resolution option 222(1) are part of the subset of the plurality of wagering games 218 for the second resolution option 222(2). This allows the player selecting the first resolution option 222(1) to see how selecting the second resolution option 222(2) might have led to a different result, and may entice the player into selecting a different option with fewer instances of a larger subset of wagering games 218 when selecting between the two resolution options 222 in the future. In this example as well, each resolution option 222, which may include resolution of multiple wagering games 218, may provide simultaneous graphical representations of the resolutions of each of the subset of wagering games 218 for each instance.

In another example, the simultaneous graphical representations of the resolutions of each of the subset of wagering games 218 may be displayed to the player before the player selects between the two resolution options 222. For example, the different resolution options 222 may have different types of awards and/or different combinations of awards, which may have different subjective values to the player. By simultaneously resolving the multiple resolution options 222, the player's excitement and engagement may be increased. In another example, the awards may be of the same type but may have different objective values, e.g., monetary awards having different award amounts. In some of these embodiments, it may be expected that the player will select the monetary award having the larger award amount. In other embodiments, the award amount may be selected automatically, randomly, or by another method. In another example, one or more of the awards may be conditioned on the player taking additional action, such as placing another wager. In these and other examples, the larger award amounts may serve as an incentive for the player to favor selecting a particular resolution option over time, and/or to place additional wagers. In this manner, these and other examples may provide strategic, skill-based, or perceived skill-based elements to the player's experience.

In one example, each resolution option 222 may have a volatility value, which may be different from each other. Each volatility value is representative of an average volatility for the resolution option 222, and may be related to the average payout value of the resolution option 222 as well. For example, one resolution option may have a higher volatility, which may result in wins being larger, but may also have a lower average payout value. This allows a player to sacrifice a portion of the overall expected payout for a resolution option 222 in exchange for the excitement of larger individual wins.

In this example, the plurality of wagering games 218 are all reel-based slot games of the same type, but it should be understood that in some embodiments, the different wagering games 218(1)-(4) may be different types, with different rules, win conditions, odds, etc. This may result in different resolution options 222 having different types or combinations of types of wagering games 218, which may add to the excitement of selecting between different resolution options 222.

Figure 3:
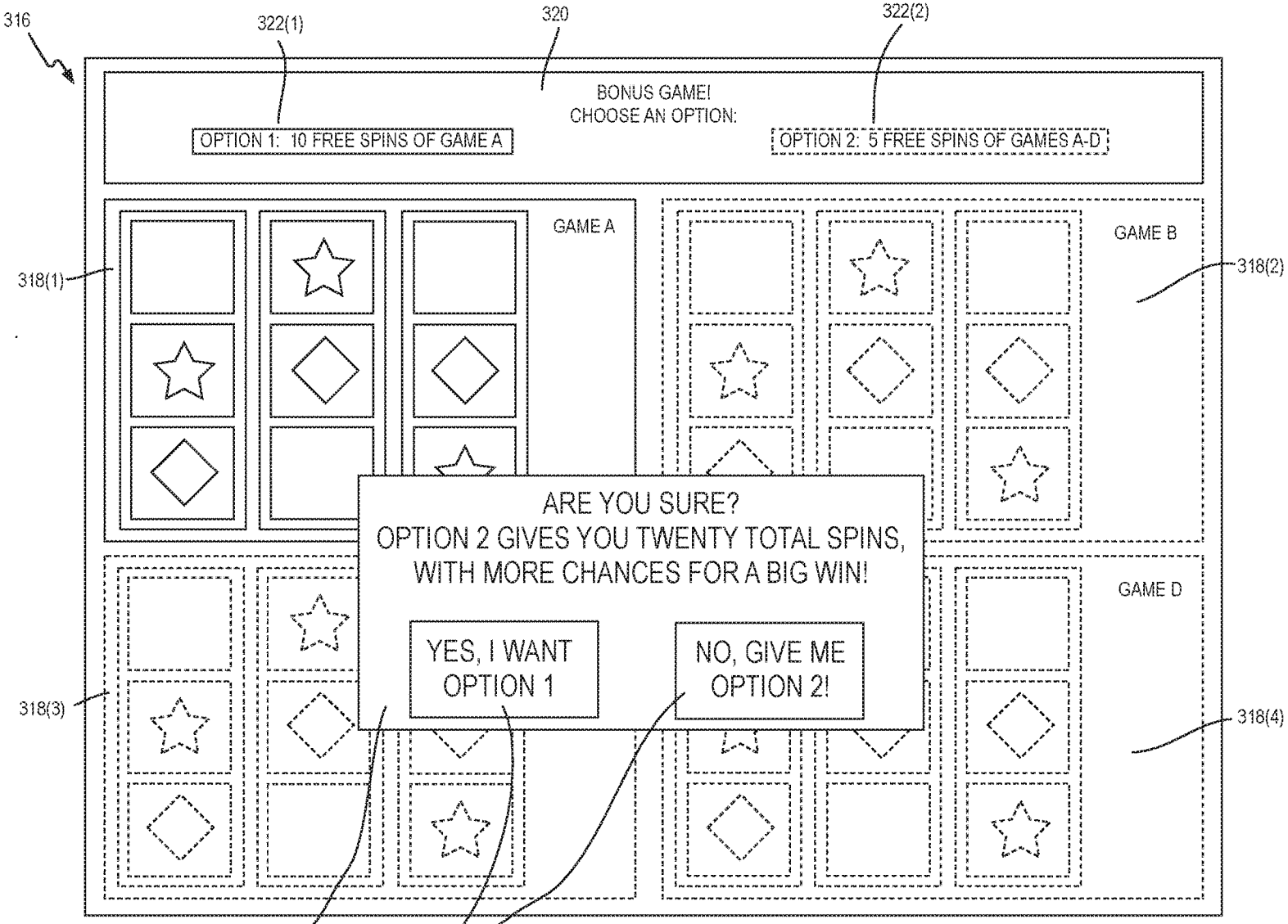
FIG. 3 illustrates elements a graphical user interface (GUI) for playing an alternative wagering game similar to the wagering game of FIGS. 1-2C, according to some embodiments.

In some examples, the player may be given an opportunity to change his mind before making a final selection for a particular resolution option. In this regard, FIG. 3 illustrates elements a graphical user interface (GUI) for playing an alternative wagering game similar to the wagering game of FIGS. 1-2, according to some embodiments. In the embodiment of FIG. 3, a GUI 316 similar to the GUI 216 of FIG. 2 is controlled in response to machine-readable instructions being executed by the processor circuit. Similar to the GUI 216 of FIG. 2, the GUI 316 displays a plurality of four wagering games 318 in a 2×2 tiled arrangement. An information display 320 provides wagering and other information for playing the wagering game(s) 318. In response to a triggering condition being satisfied, which is a bonus game triggering condition based on a resolution of a primary wagering game in this embodiment, the information display 320 displays different resolution options 322 for the plurality of wagering games 318 (i.e. bonus games in this embodiment). It should be understood, however, that other types of triggering conditions may be used, such as determining that a player has placed a wager that satisfies a predetermined wager amount, for example.

For example, as shown in FIG. 3, if a player initially selects the first resolution option 322(1), the GUI 316 may display an alert 336 that gives the player an opportunity to reconsider the selection prior to resolving the plurality of wagering games 318 according to the first resolution option 322(1). In this example, the alert 336 has buttons 338 for reconfirming the selection of the first option or changing the selection to the second option. In another example, a "buddy" avatar may appear in the GUI 316 and resolve the second resolution option 322(2) simultaneously with resolving the first resolution option 322(1). For example, in response to the player selecting the first resolution option 322(1), the avatar may appear in the GUI 316 and provide a message that the avatar will play the second resolution option 322(2) simultaneously with the resolution of the first resolution option 322(1). These and other features may increase the player's excitement and engagement, for example by providing an unsolicited benefit to the player, and may serve as an incentive for the player to favor selecting a particular resolution option over time.

It should also be understood that additional resolution options may be provided, as desired. For example, in some embodiments, the plurality of resolution options for resolving the plurality of wagering games further includes a third, fourth, or any number of additional resolution options that each include resolving a number of instances of a subset of the plurality of wagering games. In some examples, the number of options available to the player may be based on a size of the wager. For example, if the player is wagering the minimum amount, the player may only be given one option. In this example, the player may still be presented with simulated resolutions of additional wagering games, in order to entice the player into increasing his wagers. If the player doubles his wager, he may be provided with the opportunity to select a second option with multiple spins for two games, for example, while if the player wagers a maximum amount, the player may be provided with several options up to and including the opportunity to select an option with multiple spins for four (or more) games. In some examples, the additional options and/or additional available games may have better odds and/or better average payouts, which may further entice the player to increase his wagers.

Figure 4:
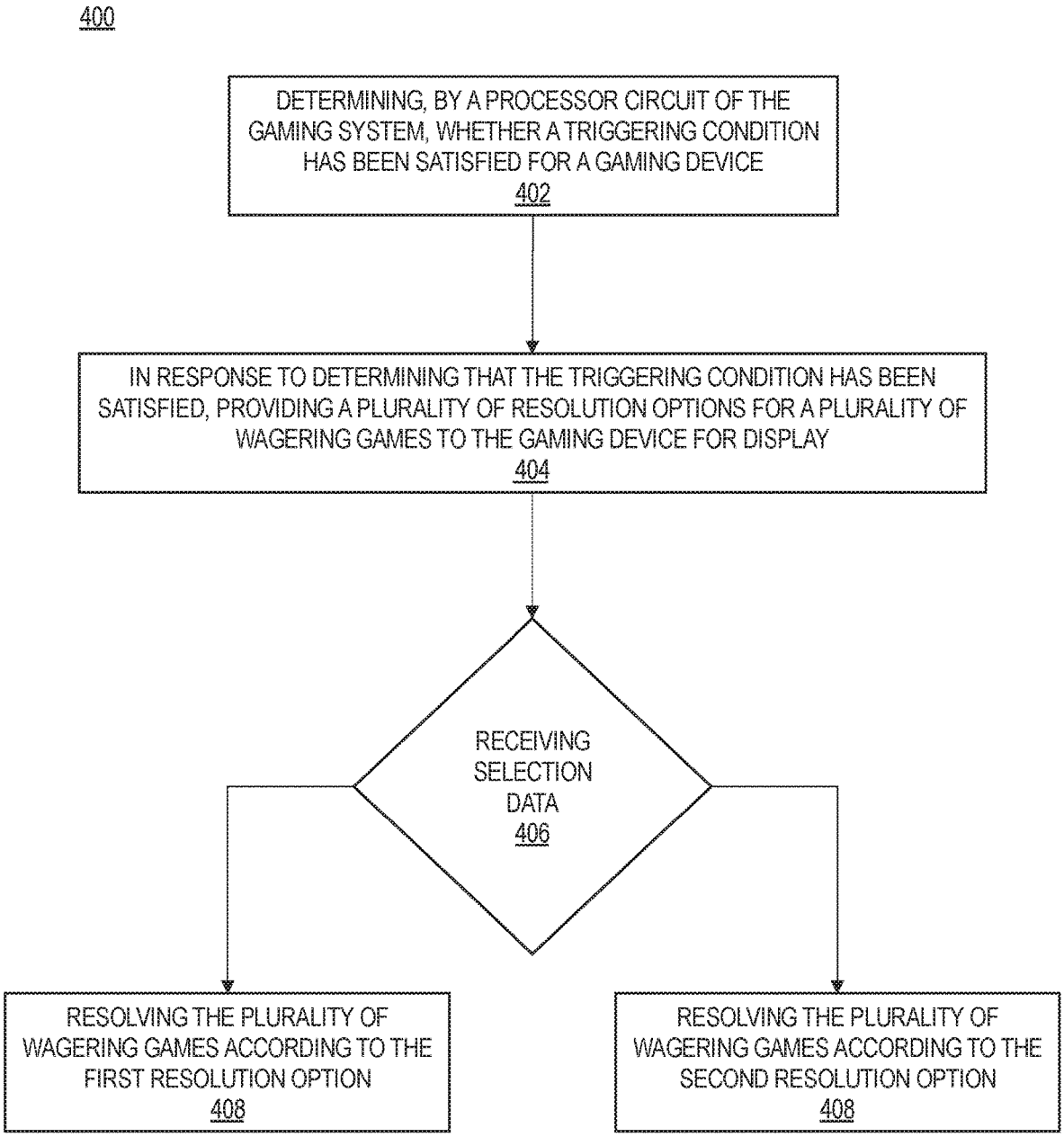
FIG. 4 is a flowchart diagram of operations for providing a wagering game with multiple resolution options, according to some embodiments.

FIG. 4 is a flowchart diagram of operations for providing a wagering game with multiple resolution options, according to some embodiments. The operations 400 include determining, by a processor circuit of the gaming system, whether a triggering condition has been satisfied for a gaming device (Block 402). The operations 400 further include, in response to determining that the triggering condition has been satisfied, providing a plurality of resolution options for a plurality of wagering games to the gaming device for display (Block 404). The resolution options include a first resolution option including resolving a first number of instances a first resolution option including resolving a first number of instances of a first subset of the plurality of wagering games, and a second resolution option including resolving a second number of instances of a second subset of the plurality of wagering games. In this embodiment, the first number of instances is different from the second number of instances, and the first subset of the plurality of wagering games is different from the second subset of the plurality of wagering games. The operations 400 further include, in response to receiving selection data (Block 406) indicative of a player of the gaming device selecting a particular resolution option of the plurality of resolution options, resolving the plurality of wagering games according to the first resolution option (Block 408) or the second resolution option (Block 410).

Figure 5:
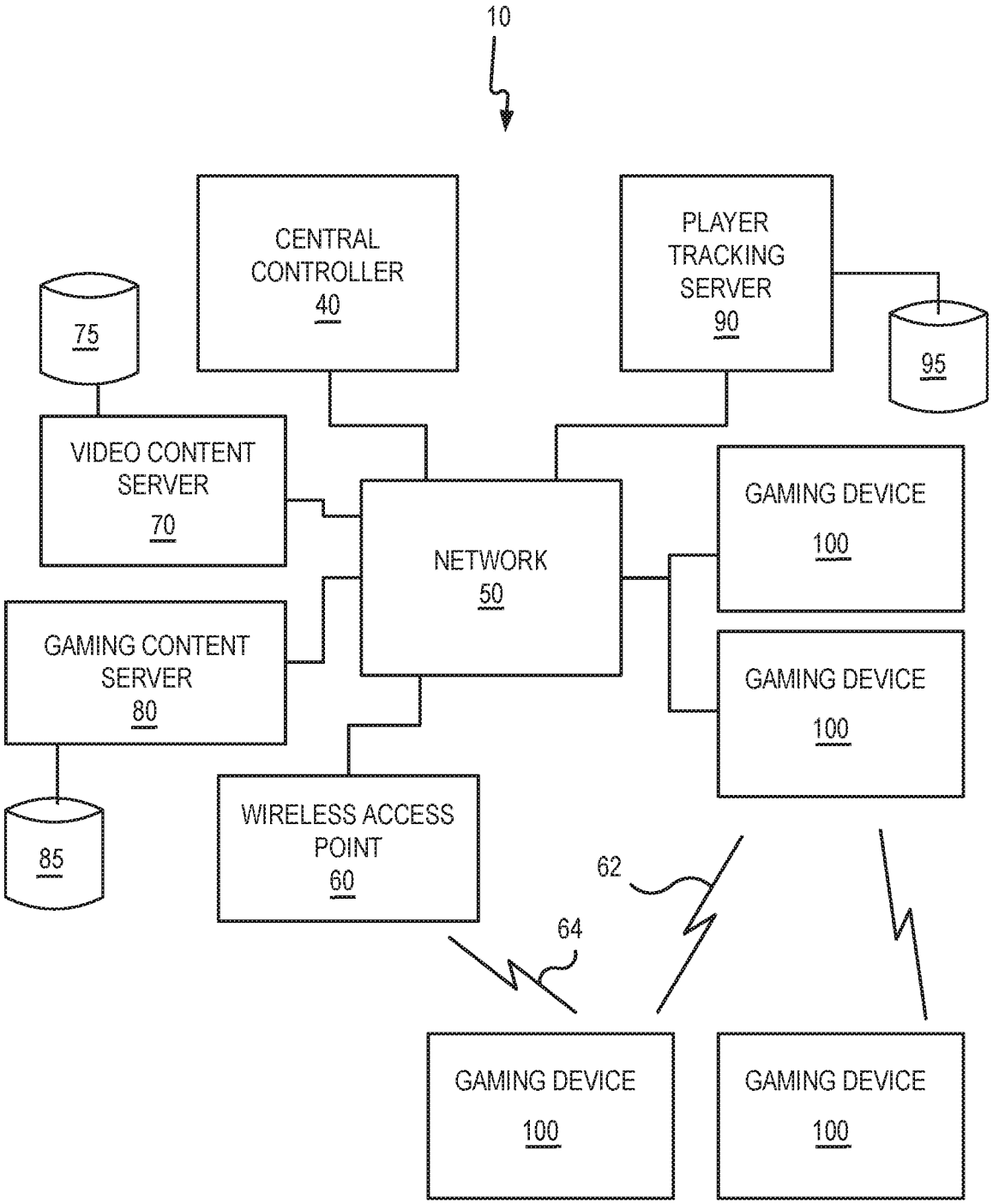
FIG. 5 is a schematic block diagram illustrating a system configuration for providing a wagering game with multiple resolution options, according to some embodiments.

Referring now to FIG. 5, embodiments may include a system 10 having a plurality of gaming devices 100 (see FIG. 1) and/or similar devices. According to the schematic block diagram of FIG. 5, the gaming system 10 may be located, for example, on the premises of a gaming establishment, such as a casino. The gaming devices 100, which may be situated on a casino floor, may be in communication with each other and/or at least one central controller 40 through a data communication network 50 or other type of network or remote communication link. The gaming devices 100 may include, for example, electronic gaming devices such as electronic gaming machines (EGMs), computing devices such as desktop or mobile computing devices, electromechanical gaming devices, or other devices.

The data communication network 50 may be a private data communication network that is operated, for example, by the gaming facility that operates the gaming device 100. Communications over the data communication network 50 may be encrypted for security. The central controller 40 may be any suitable server or computing device which includes at least one processor circuit, which may include a processor, and at least one memory or storage device. Each gaming device 100 may include a processor circuit that transmits and receives events, messages, commands or any other suitable data or signal between the gaming device 100 and the central controller 40. The gaming device processor circuit is operable to execute such communicated events, messages or commands in conjunction with the operation of the gaming device. Moreover, the processor circuit of the central controller 40 is configured to transmit and receive events, messages, commands or any other suitable data or signal between the central controller 40 and each of the individual gaming devices 100. In some embodiments, one or more of the functions of the central controller 40 may be performed by one or more gaming device processor circuits. Moreover, in some embodiments, one or more of the functions of one or more gaming device processor circuits as disclosed herein may be performed by the central controller 40.

A wireless access point 60 provides wireless access to the data communication network 50. The wireless access point 60 may be connected to the data communication network 50 as illustrated in FIG. 5, or may be connected directly to the central controller 40 or another server connected to the data communication network 50. For example, for a gaming device 100 that is a mobile gaming device, the gaming device 100 may provide game play features via an onboard processor circuit and memory via a built-in display, and may communicate with the central controller 40 and other components of the system 10 to track wagering, wins and losses based on the game result. In other embodiments, the mobile gaming device or other gaming device may be a "thin-client" that displays the game elements to the player and registers player input, while the central controller 40 performs the operations of providing and resolving the game.

A player tracking server 45 may also be connected through the data communication network 50. The player tracking server 45 may manage a player tracking account that tracks the player's gameplay and spending and/or other player preferences and customizations, manages loyalty awards for the player, manages funds deposited or advanced on behalf of the player, and other functions. Player information managed by the player tracking server 45 may be stored in a player information database 47.

As further illustrated in FIG. 5, the gaming devices 100 of the system 10 provide primary games and/or secondary games to users of the gaming devices 100. Each gaming device 100 may include standalone game content, and may also communicate with one or more elements of the system 10 to provide game content to a player of the gaming devices 100.

For example, in some embodiments, the gaming device 100 may communicate with other components of the system 10 over a wireless interface 62, which may be a WiFi (e.g., IEEE 802.11x) link, a Bluetooth (e.g., IEEE 802.15.x) link, a near field communication (NFC) (e.g., ISO/IEC 18000-3) link, etc. In other embodiments, the gaming device 100 may communicate with the data communication network 50 (and devices connected thereto, including gaming devices) over a wireless interface 64 with the wireless access point 60. The wireless interface 64 may include a WiFi link, a Bluetooth link, an NFC link, etc. In still further embodiments, the gaming device 100 may communicate simultaneously with other components of the system 10 over the wireless interface 62 and the wireless access point 60 over the wireless interface 64. In these embodiments, the wireless interface 62 and the wireless interface 64 may use different communication protocols and/or different communication resources, such as different frequencies, time slots, spreading codes, etc. For example, in some embodiments, the wireless interface 62 may be a Bluetooth link, while the wireless interface 64 may be a WiFi link.

In some embodiments, the gaming system 10 includes a game controller 70. The game controller 70 may be a computing system that communicates through the data communication network 50 with the gaming devices 100 to coordinate the provision of primary game content and/or secondary game content to one or more players using the gaming devices 100. For example, the game controller 70 may manage an electronic table game having a common dealer and/or game elements that affect multiple players of the game, such as a common dealer hand in blackjack, or a roulette spin result. The game controller 70 may be implemented within or separately from the central controller 40.

In some embodiments, the game controller 70 may coordinate the generation and display of elements of the same primary game and/or secondary game to more than one player by more than one gaming device 100. As described in more detail below, this may enable multiple players to interact with elements within the game and/or with each other in real time. This feature can be used to provide a shared multiplayer experience to multiple players at the same time. Moreover, in some embodiments, the game controller 70 may coordinate the generation and display of the same game elements to players at different gaming devices 100 at a common physical location, e.g., in a common bank of gaming devices 100, or at different physical locations, e.g., at different locations within a casino or at different locations at different casinos or other gaming establishments.

In some embodiments, at least some processing of game content, including images and/or objects that are provided by the gaming devices 100, may be performed by the game controller 70, thereby offloading at least some processing requirements from the gaming devices 100.

A back bet server 80 may be provided to manage back bets placed using a gaming device 100 as described in more detail below. A gaming device 100 may communicate with the back bet server 80 through the wireless interface 64 and network 50, for example.

Figure 6:
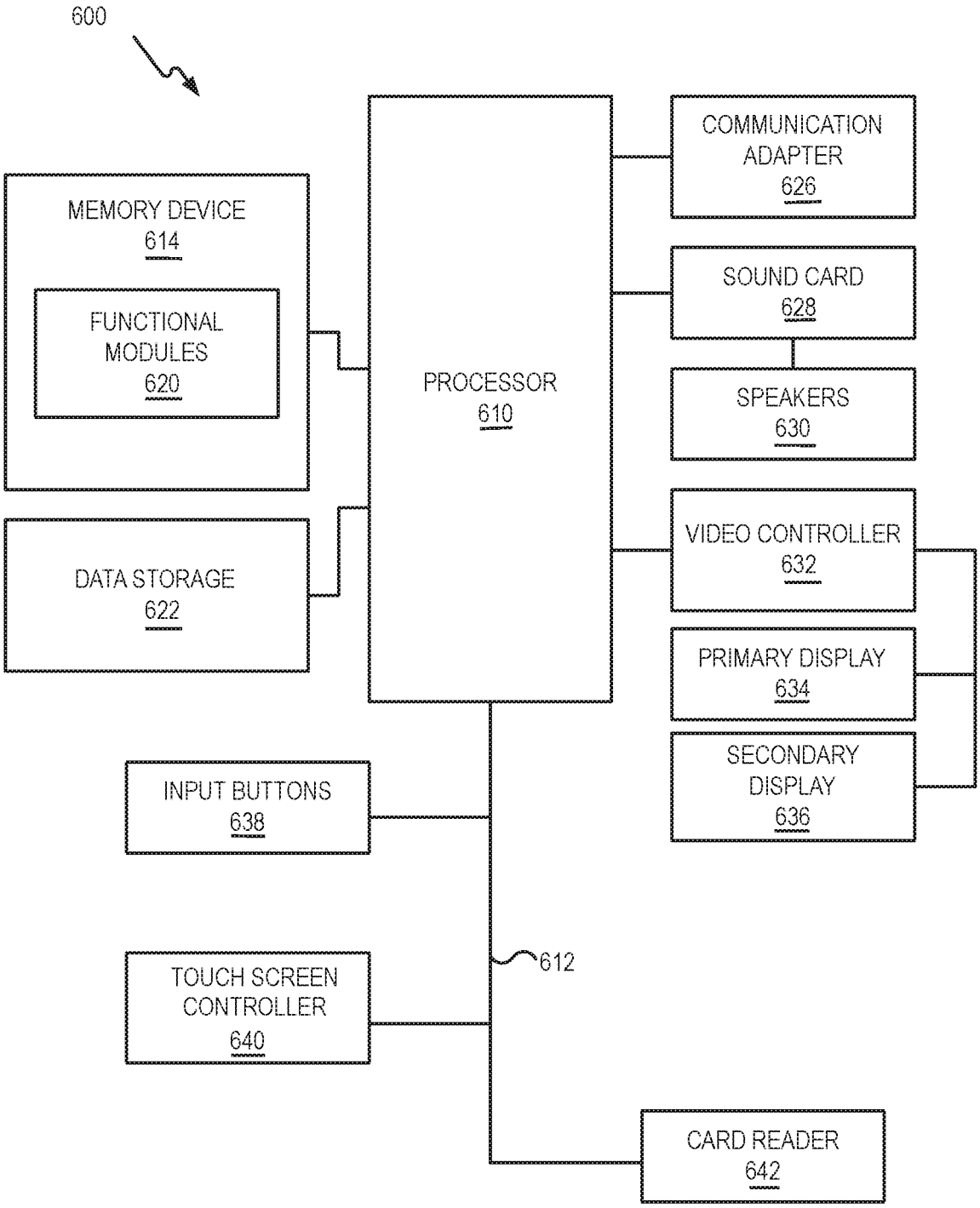
FIG. 6 is a schematic is a block diagram of components of a computing device, according to some embodiments.

Referring now to FIG. 6, a block diagram of components of a computing device 600 similar to the computing devices and components of FIG. 5 is illustrated, according to some embodiments. The computing device 600 of FIG. 6 and/or components thereof may be suitable for use as or in connection with various components of the devices, systems and methods described herein. As shown in FIG. 6, the computing device 600 may include a processor circuit 610, or processor circuit, that controls operations of the computing device 600. Although illustrated as a single processor circuit, multiple special purpose and/or general purpose processor circuits and/or processor circuit cores may be provided in the computing device 600. For example, the computing device 600 may include one or more of a video processor circuit, a signal processor circuit, a sound processor circuit and/or a communication controller that performs one or more control functions within the computing device 600. The processor circuit 610 may include and/or may be included in various components, which may be variously referred to as a "controller," "microcontroller," "microprocessor" or simply a "computer," for example. The processor circuit may further include one or more application-specific integrated circuits (ASICs).

Various components of the computing device 600 are illustrated in FIG. 6 as being connected to the processor circuit 610. It will be appreciated that the components may be connected to the processor circuit 610 through a system bus 612, a communication bus and controller, such as a USB controller and USB bus, a network interface, or any other suitable type of connection.

The computing device 600 further includes a memory device 614 that stores one or more functional modules 620 for performing the operations described above. The memory device 614 may store machine-readable instructions, such as program code for example, executable by the processor circuit 610, to control the computing device 600. The memory device 614 may include random access memory (RAM), which can include non-volatile RAM (NVRAM), magnetic RAM (ARAM), ferroelectric RAM (FeRAM) and other forms as commonly understood in the gaming industry. In some embodiments, the memory device 614 may include read only memory (ROM). In some embodiments, the memory device 614 may include flash memory and/or EEPROM (electrically erasable programmable read only memory). Any other suitable magnetic, optical and/or semiconductor memory may operate in conjunction with the gaming device disclosed herein.

The computing device 600 may further include a data storage device 622, such as a hard disk drive or flash memory. The data storage device 622 may store program data, player data, audit trail data or any other type of data. The data storage device 622 may include a detachable or removable memory device, including, but not limited to, a suitable cartridge, disk, CD ROM, DVD or USB memory device.

The computing device 600 may include a communication adapter 626 that enables the computing device 600 to communicate with remote devices over a wired and/or wireless communication network, such as a local area network (LAN), wide area network (WAN), cellular communication network, or other data communication network. The communication adapter 626 may further include circuitry for supporting short range wireless communication protocols, such as Bluetooth and/or near field communications (NFC) that enable the computing device 600 to communicate, for example, with a mobile communication device operated by a player.

The computing device 600 may include one or more internal or external communication ports that enable the processor circuit 610 to communicate with and to operate with internal or external peripheral devices, such as a sound card 628 connected to speakers 630, a video controller 632 connected to a primary display 634 and/or a secondary display 636, input buttons 638, a touch screen controller 640, or a card reader 642, for example. Additional internal or external peripheral devices that may be used include eye tracking devices, position tracking devices, cameras, accelerometers, arcade sticks, bar code readers, bill validators, biometric input devices, button panels, card readers, currency acceptors and dispensers, additional displays or video sources, expansion buses, information panels, keypads, lights, mass storage devices, microphones, motion sensors, motors, printers, reels, SCSI ports, solenoids, speakers, thumb drives, ticket readers, trackballs, touchpads, wheels, and wireless communication devices. In some embodiments, internal or external peripheral devices may communicate with the processor circuit through a universal serial bus (USB) hub (not shown) connected to the processor circuit 610.

The computing device 600 may include 3D display device, which may be part of the primary display 634, secondary display 636, or another display. For example, the 3D display device may be a stereoscopic display device, wherein displaying the deflection pegs to simulate the deflection pegs extending away from the reference plane includes displaying a first image of the game board from a first perspective of a first eye of a user, and displaying a second image of the game board from a second perspective of a second eye of the user. In some embodiments, the primary display 634, the secondary display 636, and/or another display device may include a head-wearable display frame that, in response to being worn by the player, positions the 3D display device in a field of view of the player.

The present disclosure contemplates a variety of different systems and/or devices, each having one or more of a plurality of different features, attributes, or characteristics. In certain such embodiments, computerized instructions for controlling any features or content displayed by the display devices or other devices are executed by the central server, central controller, or remote host. In such "thin client" embodiments, the central server, central controller, or remote host remotely controls any games (or other suitable interfaces) displayed by the device, and the device is utilized to display such features (or other suitable interfaces) and to receive one or more inputs or commands. In other such embodiments, computerized instructions for controlling any features displayed by the device are communicated from the central server, central controller, and/or remote host to the device and are stored in at least one memory device of the device. In such "thick client" embodiments, the processor circuit of the device executes the computerized instructions to control any games (or other suitable interfaces) displayed by the device.

In some embodiments in which the system may include: (a) a device configured to communicate with a central server, central controller, or remote host through a data network; and/or (b) a plurality of devices configured to communicate with one another through a data network, the data network is an internet or an intranet. In these and other embodiments, an internet browser of the device is usable to access an internet game page from any location where an internet connection is available. In one such embodiment, after the internet content page is accessed, the central server, central controller, or remote host identifies a user prior to enabling that user to use particular features. In one example, the central server, central controller, or remote host identifies the user by determining that the user is logged into a user account via an input of a unique username and password combination assigned to the user. It should be appreciated, however, that the central server, central controller, and/or remote host may identify the user in any other suitable manner, such as by validating a user tracking identification number associated with the user; by reading a user tracking card or other smart card inserted into a card reader (as described below); by validating a unique user identification number associated with the user by the central server, central controller, and/or remote host; or by identifying the device, such as by identifying the MAC address or the IP address of the internet facilitator. In various embodiments, once the central server, central controller, and/or remote host identifies the user, the central server, central controller, and/or remote host enables features and/or content, and displays the features and/or content via the internet browser of the gaming device.

It should be appreciated that the central server, central controller, and/or remote host and the device(s) are configured to connect to the data network or remote communications link in any suitable manner. In various embodiments, such a connection may be accomplished via: a conventional phone line or other data transmission line, a digital subscriber line (DSL), a T-1 line, a coaxial cable, a fiber optic cable, a wireless or wired routing device, a mobile communications network connection (such as a cellular network or mobile internet network), or any other suitable medium. It should be appreciated that the expansion in the quantity of computing devices and the quantity and speed of internet connections in recent years increases opportunities for players to use a variety of devices from an ever-increasing quantity of remote sites. It should also be appreciated that the enhanced bandwidth of digital wireless communications may render such technology suitable for some or all communications, such as encrypted communications, for example. Higher data transmission speeds may be useful for enhancing the sophistication and response of the display and interaction with users.

As will be appreciated by one skilled in the art, aspects of the present disclosure may be illustrated and described herein in any of a number of patentable classes or context including any new and useful process, machine, manufacture, or composition of matter, or any new and useful improvement thereof. Accordingly, aspects of the present disclosure may be implemented entirely hardware, entirely software (including firmware, resident software, microcode, etc.) or combining software and hardware implementation that may all generally be referred to herein as a "circuit," "module," "component," or "system." Furthermore, aspects of the present disclosure may take the form of a computer program product embodied in one or more machine-readable media having machine-readable instructions, such as computer readable media having computer readable program code for example, embodied thereon.

Any combination of one or more machine-readable media may be utilized. The machine-readable media may be a machine-readable signal medium or a machine-readable storage medium. A machine-readable storage medium may be, for example, but not limited to, an electronic, magnetic, optical, electromagnetic, or semiconductor system, apparatus, or device, or any suitable combination of the foregoing. More specific examples (a non-exhaustive list) of the machine-readable storage medium would include the following: a portable computer diskette, a hard disk, a random access memory (RAM), a read-only memory (ROM), an erasable programmable read-only memory (EPROM or Flash memory), an appropriate optical fiber with a repeater, a portable compact disc read-only memory (CD-ROM), an optical storage device, a magnetic storage device, or any suitable combination of the foregoing. In the context of this document, a machine-readable storage medium may be any medium that can contain, or store a program for use by or in connection with an instruction execution system, apparatus, or device.

A machine-readable signal medium may include a propagated data signal with machine-readable instructions embodied therein, for example, in baseband or as part of a carrier wave. Such a propagated signal may take any of a variety of forms, including, but not limited to, electromagnetic, optical, or any suitable combination thereof. A machine-readable signal medium may be any machine-readable medium that is not a machine-readable storage medium and that can communicate, propagate, or transport a program for use by or in connection with an instruction execution system, apparatus, or device. Instructions embodied on a machine-readable signal medium may be transmitted using any appropriate medium, including but not limited to wireless, wireline, optical fiber cable, RF, etc., or any suitable combination of the foregoing.

Computer program code for carrying out operations for aspects of the present disclosure may be written in any combination of one or more programming languages, including an object oriented programming language such as Haxe, Java, Scala, Smalltalk, Eiffel, JADE, Emerald, C++, C #, VB.NET, Python or the like, conventional procedural programming languages, such as JavaScript, the "C" programming language, Visual Basic, Fortran 2003, Perl, COBOL 2002, PHP, ABAP, dynamic programming languages such as Python, Ruby and Groovy, or other programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider) or in a cloud computing environment or offered as a service such as a Software as a Service (SaaS).

Aspects of the present disclosure are described herein with reference to flowchart illustrations and/or block diagrams of methods, apparatuses (systems) and computer program products according to embodiments of the disclosure. It will be understood that each block of the flowchart illustrations and/or block diagrams, and combinations of blocks in the flowchart illustrations and/or block diagrams, can be implemented by computer program instructions. These computer program instructions may be provided to a processor circuit of a general purpose computer, special purpose computer, or other programmable data processing apparatus to produce a machine, such that the instructions, which execute via the processor circuit of the computer or other programmable instruction execution apparatus, create a mechanism for implementing the functions/acts specified in the flowchart and/or block diagram block or blocks.

These computer program instructions may also be stored in a machine-readable medium that when executed can direct a computer, other programmable data processing apparatus, or other devices to function in a particular manner, such that the instructions when stored in the machine-readable medium produce an article of manufacture including instructions which when executed, cause a computer to implement the function/act specified in the flowchart and/or block diagram block or blocks. The computer program instructions may also be loaded onto a computer, other programmable instruction execution apparatus, or other devices to cause a series of operational steps to be performed on the computer, other programmable apparatuses or other devices to produce a computer implemented process such that the instructions which execute on the computer or other programmable apparatus provide processes for implementing the functions/acts specified in the flowchart and/or block diagram block or blocks.

The flowchart and block diagrams in the figures illustrate the architecture, functionality, and operation of possible implementations of systems, methods, and computer program products according to various aspects of the present disclosure. In this regard, each block in the flowchart or block diagrams may represent a module, segment, or portion of code, which includes one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The terminology used herein is for the purpose of describing particular aspects only and is not intended to be limiting of the disclosure. As used herein, the singular forms "a", "an" and "the" are intended to include the plural forms as well and may be interpreted as "one or more", unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof. As used herein, the term "and/or" includes any and all combinations of one or more of the associated listed items and may be designated as "/". Like reference numbers signify like elements throughout the description of the figures.

Many different embodiments have been disclosed herein, in connection with the above description and the drawings. It will be understood that it would be unduly repetitious and obfuscating to literally describe and illustrate every combination and subcombination of these embodiments. Accordingly, all embodiments can be combined in any way and/or combination, and the present specification, including the drawings, shall be construed to constitute a complete written description of all combinations and subcombinations of the embodiments described herein, and of the manner and process of making and using them, and shall support claims to any such combination or subcombination.

What is claimed is:

1. A gaming system comprising:

a processor circuit; and a memory coupled to the processor circuit, the memory comprising machine-readable instructions that, when executed by the processor circuit, cause the processor circuit to:

determine whether a triggering condition has been satisfied for a gaming device;

in response to determining that the triggering condition has been satisfied, provide a plurality of resolution options for a plurality of wagering games to the gaming device for display, the plurality of resolution options for resolving the plurality of wagering games comprising:

a first resolution option comprising resolving a first number of instances of a first subset of the plurality of wagering games; and a second resolution option comprising resolving a second number of instances of a second subset of the plurality of wagering games, wherein the first number of instances is different from the second number of instances, and wherein the first subset of the plurality of wagering games comprises a different number of wagering games than the second subset of the plurality of wagering games; and in response to receiving selection data indicative of a player of the gaming device selecting a particular resolution option of the plurality of resolution options, resolve the plurality of wagering games according to the particular resolution option.

2. The gaming system of claim 1, wherein the first number of instances is larger than the second number of instances, and wherein the first subset of the plurality of wagering games is smaller than the second subset of the plurality of wagering games.

3. The gaming system of claim 1, wherein the first resolution option comprises a first average payout value, and wherein the second resolution option comprises a second average payout value different than the first average payout value.

4. The gaming system of claim 1, wherein the first number of instances times the number of wagering games in the first subset of the plurality of wagering games is equal to the second number of instances times the number of wagering games in the second subset of the plurality of wagering games.

5. The gaming system of claim 1, wherein the second resolution option further comprises providing a graphical representation of a simulated resolution of an instance of a particular wagering game to the gaming device for display, and wherein the particular wagering game is part of the first subset of the plurality of wagering games and wherein the particular wagering game is not part of the second subset of the plurality of wagering games.

6. The gaming system of claim 5, wherein the first resolution option further comprises providing simultaneous graphical representations of the resolutions of each of the first number of instances of the first subset of the plurality of wagering games to the gaming device for display, and wherein the second resolution option further comprises providing simultaneous graphical representations of the resolutions of each of the second number of instances of the second subset of the plurality of wagering games and of the simulated resolution of the instance of the particular wagering game to the gaming device for display.

7. The gaming system of claim 1, wherein the first resolution option comprises a first volatility value, and wherein the second resolution option comprises a second volatility value different from the first volatility value.

8. The gaming system of claim 7, wherein the first volatility value is larger than the second volatility value, wherein the first resolution option comprises a first average payout value, and wherein the second resolution option comprises a second average payout value larger than the first average payout value.

9. The gaming system of claim 1, wherein the plurality of wagering games comprises a first wagering game and a second wagering game different from the first wagering game, wherein the first subset of the plurality of wagering games comprises the first wagering game, and wherein the second subset of the plurality of wagering games comprises the second wagering game.

10. The gaming system of claim 9, wherein the first subset of the plurality of wagering games does not comprise the second wagering game, and wherein the second subset of the plurality of wagering games does not comprise the first wagering game.

11. The gaming system of claim 1, wherein machine-readable instructions further cause the processor circuit to:

determine that the player has initially selected the first resolution option;

in response to determining that the player has initially selected the first resolution option, provide the first resolution option and the second resolution option to the player prior to resolving the plurality of wagering games; and determining that the player has selected a particular resolution option of the plurality of resolution options, wherein selecting the particular resolution option comprises selecting one the first resolution option and the second resolution option.

12. The gaming system of claim 1, wherein the plurality of resolution options for resolving the plurality of wagering games further comprises a third resolution option comprising resolving a third number of instances of a third subset of the plurality of wagering games, wherein the third number of instances is different from the first number of instances and the second number of instances, and wherein the third subset of the plurality of wagering games is different from the first subset of the plurality of wagering games and the second subset of the plurality of wagering games.

13. The gaming system of claim 1, wherein the triggering condition comprises the player placing a wager that satisfies a predetermined wager amount.

14. The gaming system of claim 1, wherein the triggering condition comprises a bonus game triggering condition based on a resolution of a primary wagering game, and wherein the plurality of wagering games comprise a plurality of bonus games.

15. A computer-implemented method of operating a gaming system comprising:

determining, by a processor circuit of the gaming system, whether a triggering condition has been satisfied for a gaming device;

in response to determining that the triggering condition has been satisfied, providing a plurality of resolution options for a plurality of wagering games to the gaming device for display, the plurality of resolution options for resolving the plurality of wagering games comprising:

a first resolution option comprising resolving a first number of instances of a first subset of the plurality of wagering games; and a second resolution option comprising resolving a second number of instances of a second subset of the plurality of wagering games, wherein the first number of instances is different from the second number of instances, and wherein the first subset of the plurality of wagering games comprises a different number of wagering games than the second subset of the plurality of wagering games; and in response to receiving selection data indicative of a player of the gaming device selecting a particular resolution option of the plurality of resolution options, resolving the plurality of wagering games according to the particular resolution option.

16. The computer-implemented method of claim 15, wherein the first number of instances is larger than the second number of instances, and wherein the first subset of the plurality of wagering games is smaller than the second subset of the plurality of wagering games.

17. The computer-implemented method of claim 15, wherein the first resolution option comprises a first average payout value, and wherein the second resolution option comprises a second average payout value different than the first average payout value.

18. The computer-implemented method of claim 15, wherein the first number of instances times the number of wagering games in the first subset of the plurality of wagering games is equal to the second number of instances times the number of wagering games in the second subset of the plurality of wagering games.

19. The computer-implemented method of claim 15, wherein the second resolution option further comprises displaying a simulated resolution of an instance of a particular wagering game, and wherein the particular wagering game is part of the first subset of the plurality of wagering games and wherein the particular wagering game is not part of the second subset of the plurality of wagering games.

20. A gaming device comprising:

a display device;

an input device;

a processor circuit; and a memory coupled to the processor circuit, the memory comprising machine-readable instructions that, when executed by the processor circuit, cause the processor circuit to:

determine whether a triggering condition has been satisfied;

in response to determining that the triggering condition has been satisfied, provide a plurality of resolution options for a plurality of wagering games to the display device for display, the plurality of resolution options for resolving the plurality of wagering games comprising:

a first resolution option comprising resolving a first number of instances of a first subset of the plurality of wagering games; and a second resolution option comprising resolving a second number of instances of a second subset of the plurality of wagering games, wherein the first number of instances is different from the second number of instances, and wherein the first subset of the plurality of wagering games comprises a different number of wagering games than the second subset of the plurality of wagering games; and in response to a player selecting a particular resolution option of the plurality of resolution options using the input device, resolve the plurality of wagering games according to the particular resolution option.

* * * * *